US006603433B1

(12) United States Patent
Richard Max et al.

(10) Patent No.: US 6,603,433 B1
(45) Date of Patent: Aug. 5, 2003

(54) POSITIONING STRUCTURE OF INNER AND OUTER INSULATION SLEEVE MEMBERS FOR ANTENNA

(75) Inventors: Xu Richard Max, Pa-Te (TW); Jacky Weng, Taipei Hsien (TW); Alen Chan, Tali (TW); Darren Peng, Pa-Te (TW); Wei Ye, Chung-Li (TW); Tony Wu, Pa-Te (TW)

(73) Assignee: Auden Techno Corp., Taoyuan Hsien (TW)

( * ) Notice: Subject to any disclaimer, the term of this patent is extended or adjusted under 35 U.S.C. 154(b) by 0 days.

(21) Appl. No.: 10/084,954

(22) Filed: Mar. 1, 2002

(51) Int. Cl.[7] ..... H01Q 1/24
(52) U.S. Cl. ..... 343/702; 343/895
(58) Field of Search ..... 343/702, 866, 343/867, 872, 895, 906; H01Q 1/24, 1/36

(56) References Cited

U.S. PATENT DOCUMENTS 6,127,979 A * 10/2000 Zhou et al. ..... 343/702
6,337,669 B1 * 1/2002 Chiang ..... 343/895
6,340,955 B1 * 1/2002 Chao ..... 343/895
6,344,827 B1 * 2/2002 Wu ..... 343/702
6,369,775 B1 * 4/2002 Moore et al. ..... 343/893
6,476,777 B1 * 11/2002 Lin et al. ..... 343/895
6,518,938 B1 * 2/2003 Chaoo ..... 343/895

* cited by examiner

*Primary Examiner*—Tho Phan
(74) *Attorney, Agent, or Firm*—Troxell Law Office PLLC

(57) ABSTRACT

A positioning structure of an inner and an outer insulation sleeve member for an antenna, the sleeve members are an outer insulation sleeve and an inner insulation connecting rod insertion connecting with each other to form the main housing of the antenna, wherein, the inner connecting rod has thereon an upper and a lower protruding rib in corresponding respectively to an upper and a lower inner annular recess provided on the outer sleeve. The lower inner annular recess and the lower protruding rib had better be both in a truncated conical shape flared downwardly to form an abutting shoulder to help guiding for insertion connecting and to prevent slipping off of them by an axial pulling force. The inner connecting rod has thereon notches corresponding in position to the pending tongs on the top of the outer sleeve; and the inner and the outer sleeve members can synchronically be positioned in the peripheral direction.

3 Claims, 3 Drawing Sheets

POSITIONING STRUCTURE OF INNER AND OUTER INSULATION SLEEVE MEMBERS FOR ANTENNA

BACKGROUND OF THE INVENTION

1. Field of the Invention

The present invention is related to a positioning structure of an inner and an outer insulation sleeve member for an antenna; and especially to such an antenna of which an outer insulation sleeve and an inner insulation connecting rod (both are sleeve members) can be directly engaged with each other when in assembling to increase the torsional strength of the antenna in positioning in the peripheral direction of these inner and outer sleeve members.

2. Description of the Prior Art

Fixed antennas used in a mobile phone as an example mostly each uses an internal helical coil as a main element for transmitting and receiving signals. The bottom end of the helical coil and a metallic connecting seat are connected with each other, while on the other hand, it requires an outer insulation sleeve and an inner connecting rod to position and insulate itself.

Such a fixed antenna used in a conventional mobile phone can be positioned by primary connecting of the helical coil with the metallic connecting seat and then by connecting the outer insulation sleeve member (i.e. an ordinary cap) with the inner connecting rod. Such a connecting structure can further be combined firmer through a procedure such as high frequency melting-connecting; hence it must have equipment for melting connecting. Alternatively, the related members including the helical coil and the metallic connecting seat having been positioned can be placed in a die; and then the outer insulation sleeve is formed during injection enveloping. However, these processes for obtaining such structure is inconvenient by the necessity of placing the primarily connected members into a die for processing, and production of each article must be done in the die, yield of the products thereby is limited.

Although there have been the devices to direct connect by engaging an outer insulation sleeve with an inner connecting rod to form some antenna assembling structures now available, they can reduce extra procedures of processing to speed up production. However, such assembling structures generally are not quite stable, dropping can often happen when users of mobile phones fondle with antennas or are inadvertent in use. The torsional strength of such direct engaging structures available now generally is hard to pass severer regulations of examinations.

SUMMARY OF THE INVENTION

The object of the present invention is to provide a positioning structure of an inner connecting rod and an outer insulation sleeve (both are sleeve members) for an antenna, wherein, when the inner connecting rod of a helical coil and the outer insulation sleeve are shaped respectively, they can be engaged with each other with engaging means provided thereon, and synchronic positioning in the peripheral direction can be done at about the top ends of them, in this mode, the torsional strength of the antenna can be increased, such antenna can be manufactured with a high rate and a high yield.

In order to get the above stated object, the outer insulation sleeve of the present invention is made to have a top sealed end and a bottom opening, and an inner bore gradually enlarged from the top to the bottom thereof is provided therein, an upper inner annular recess and a lower inner annular recess are provided along the longitudinal wall of the inner bore. The inner connecting rod is provided thereon in coincidence with the structure of the abovementioned inner bore respectively with an outer rod portion, an upper and a lower annular protruding rib, the inner connecting rod can be inserted from the abovementioned bottom opening into the outer insulation sleeve. The outer insulation sleeve is provided near the inner top surface thereof with pending tongs, while the inner connecting rod is provided thereon with notches having corresponding shapes to the pending tongs respectively; thereby, the pending tongs can be inserted into the notches for positioning in the peripheral direction when the outer insulation sleeve is slipped over the inner connecting rod for connecting.

As to the pending tongs and the notches matching mutually, the pending tongs had better each be narrower at the lower end and wider at the upper end thereof for convenience of insertion positioning axially. In another preferred embodiment, the outer insulation sleeve and the inner connecting rod had better have their respective lower inner annular recess and the lower annular protruding rib provided with a stop portion with a truncated conical shape.

The present invention will be apparent in its novelty and other features after reading the detailed description of the preferred embodiment thereof in reference to the accompanying drawings.

DETAILED DESCRIPTION OF THE PREFERRED EMBODIMENT

Figure 1:
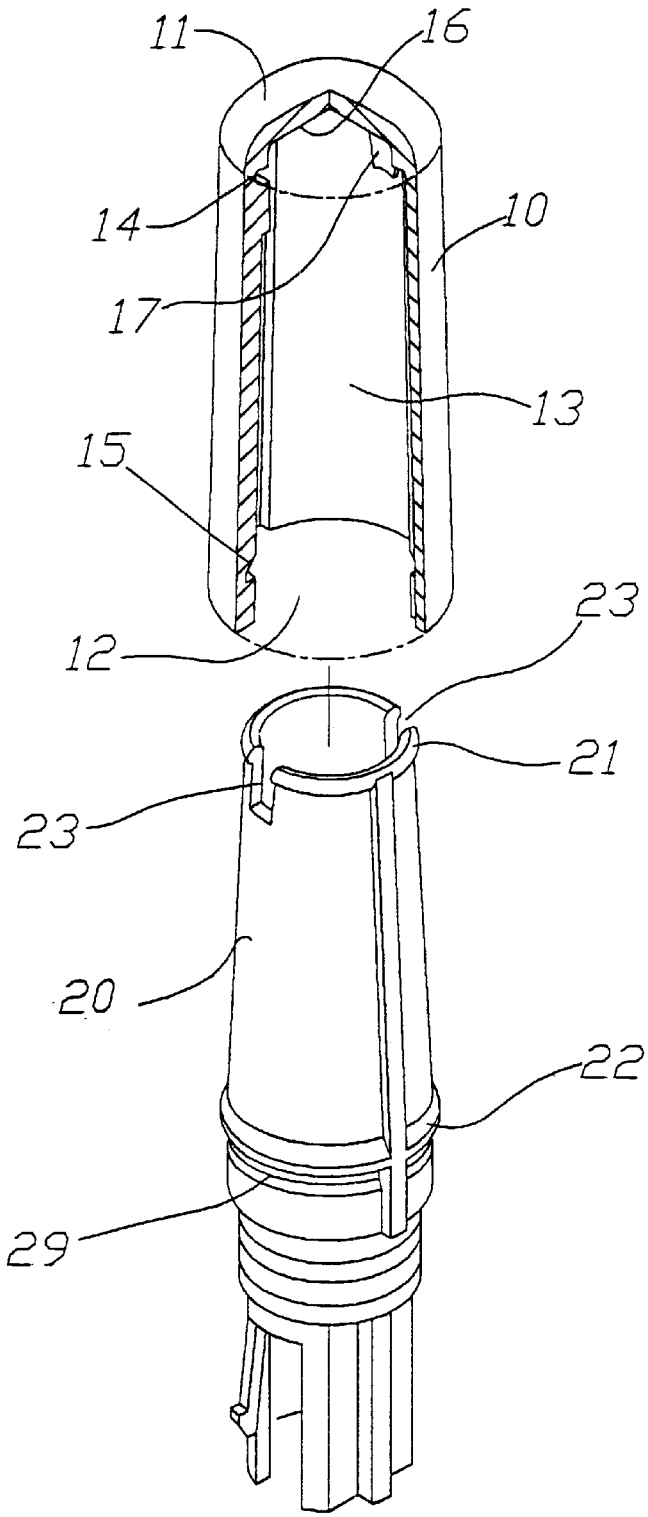
FIG. 1 is a partially sectional perspective view showing the mutually separated outer insulation sleeve and inner connecting rod of the present invention.

Referring to FIG. 1 firstly, the main housing of the antenna has the principal elements including an outer insulation sleeve (namely cap) 10 and an inner insulation connecting rod 20. Related antenna parts including a coil, a metallic seat and a contact piece can be mounted therein after insertion connecting of the elements.

Figure 5:
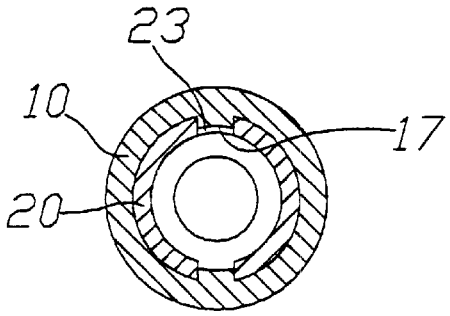
FIG. 5 is a sectional view taken from the sectional line 5—5 of FIG. 3.

The outer insulation sleeve 10 basically has a top sealed end 11 and a bottom opening 12, and an inner bore 13 gradually enlarged from the top to the bottom thereof is provided therein with an upper inner annular recess 14 and a lower inner annular recess 15 provided along the longitudinal wall thereof; and is provided near the inner top surface 16 thereof with pending tongs 17. In the embodiment shown in the drawing, the pending tongs 17 each is in a conical shape which is narrower at the lower end and wider at the upper end thereof (referring to FIGS. 3, 5). While the inner connecting rod 20 is provided thereon in corresponding to structure of the outer insulation sleeve 10 with an upper protruding rib protruding rib 21 and a lower annular protruding rib 22, and is provided on the top end of the wall thereof with notches 23 having a corresponding shape to the pending tongs 17 of the outer insulation sleeve 10 respectively.

Figure 4:
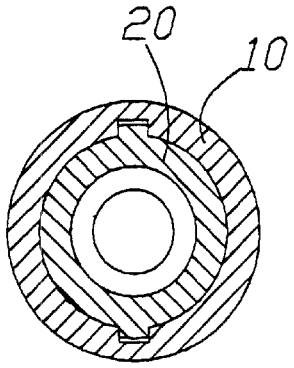
FIG. 4 is a sectional view taken from the sectional line 4—4 of FIG. 2.
Figure 2:
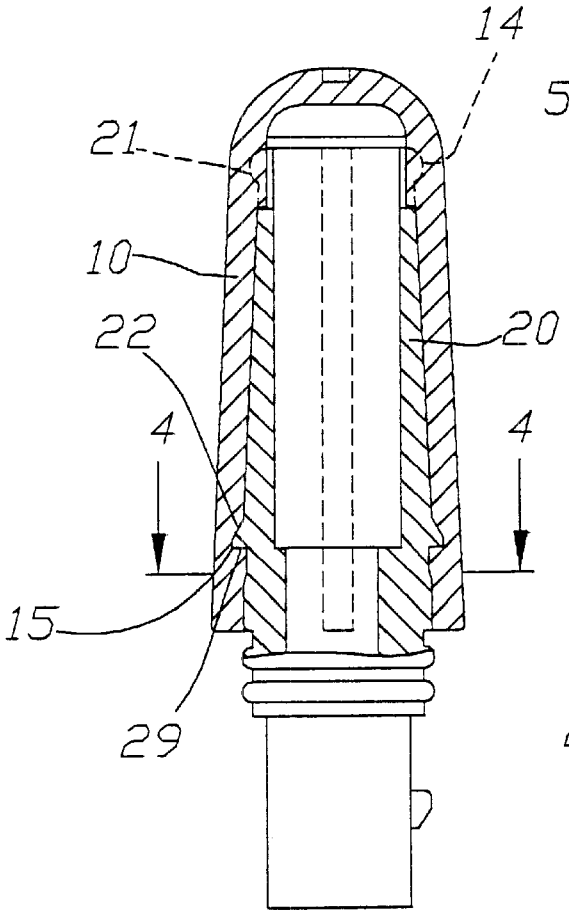
FIG. 2 is a sectional view taken from and in the same orientation as that of FIG. 1.

In the preferred embodiment shown in FIGS. 2, 4, the lower annular protruding rib 22 is in a truncated conical shape flared downwardly to form an abutting shoulder 29. The lower inner annular recess 15 provided on the outer insulation sleeve 10 is in the shape in corresponding to that of the abutting shoulder 29.

Figure 3:
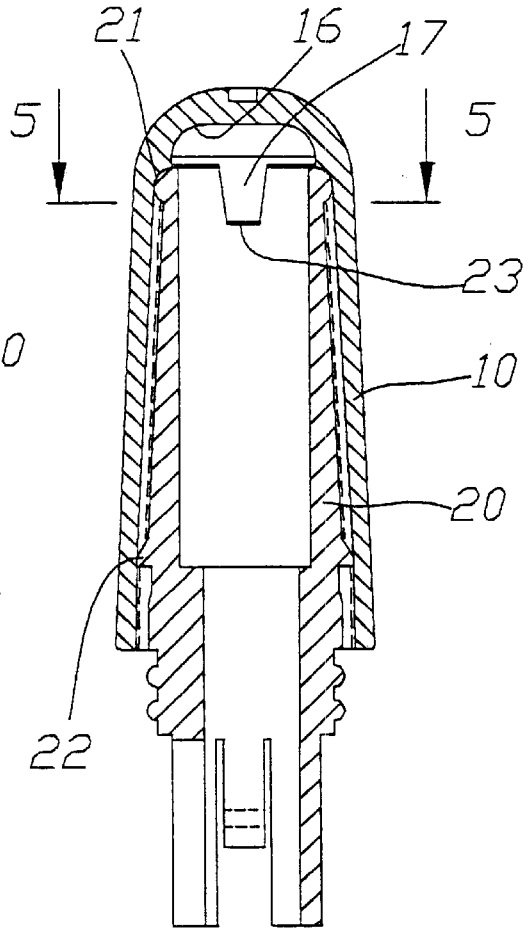
FIG. 3 is a sectional view taken in the orientation 90 degrees away from that of FIG. 2.

The outer insulation sleeve 10 and the inner connecting rod 20 of such structure can thereby insertion connected with each other in an axial direction. During insertion connecting of the two, by virtue that the outer insulation sleeve 10 is generally formed of plastic, in the procedure of insertion of the main shank of the inner connecting rod 20 into the inner bore 13, the upper protruding rib protruding rib 21 and the lower annular protruding rib 22 slightly spread in the first place, and when the inner connecting rod 20 reaches its position (such as are shown in FIGS. 2, 3), the outer insulation sleeve 10 will make the upper and the lower inner annular recesses 14, 15 engage the upper and the lower protruding ribs 21, 22 respectively. By virtue that the shapes of the lower protruding rib 22 and the lower inner annular recess 15 are corresponding to each other, they form extremely firm engagement, when the antenna is exerted with an axial pulling force, not only the lower protruding rib 22 has a guiding angle to help insertion by having the truncated conical shape thereof flared downwardly, but also the abutting shoulder 29 thereof can form an effective stopping portion to prevent slipping off thereof by the axial pulling force.

When the outer insulation sleeve 10 and the inner connecting rod 20 are insertion positioned, the notches 23 provided on the inner connecting rod 20 will be synchronically connected with the pending tongs 17 on the top of the outer insulation sleeve 10. With the above stated firm connecting structure, the pending tongs 17 entering the notches 23 will form a means for positioning in the peripheral direction. So that when the outer insulation sleeve 10 is exerted with a twisting force, it can be still kept firm in its stationary state.

In the preferred embodiment stated above, the pending tongs 17 which each is narrower at the lower end and wider at the upper end thereof and the notches 23 also each being narrower at the lower end and wider at the upper end thereof in coincidence in shape with the corresponding pending tong 17 can have desire space tolerance for primary insertion connecting, their force bearing area can be increased, while insertion connecting of them can be easier.

Figure 6:
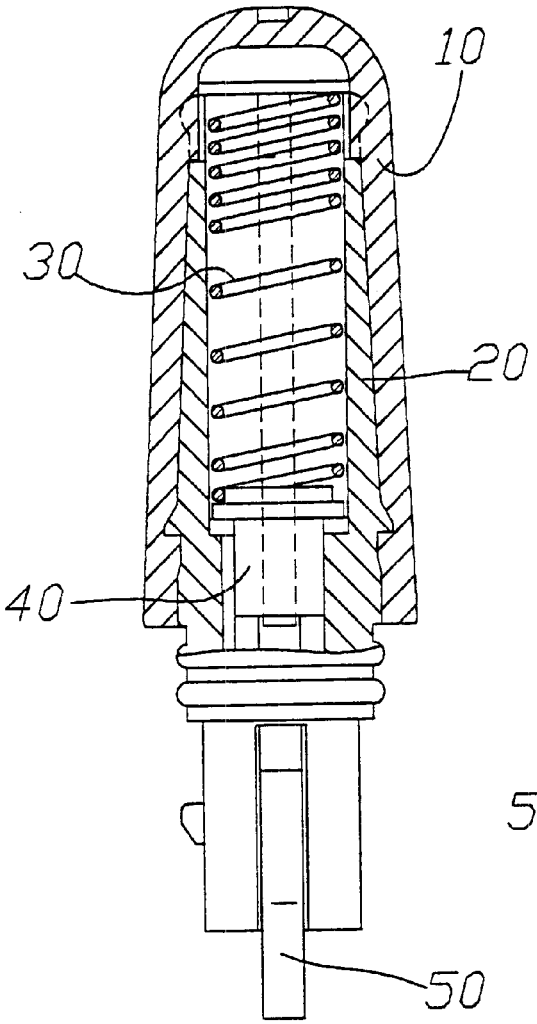
FIG. 6 is a sectional view as that of FIG. 2 with related elements mounted therein.
Figure 7:
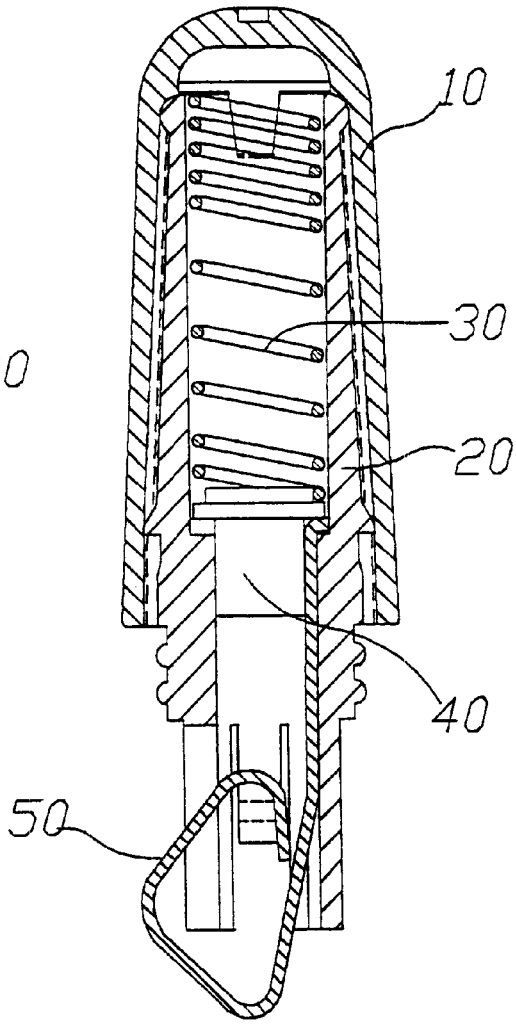
FIG. 7 is a sectional view as that of FIG. 3 with related elements mounted therein.

FIGS. 6 and 7 show that the outer insulation sleeve 10 and the inner connecting rod 20 are placed respectively therein a coil 30, a metallic seat 40 and a contact piece 50 etc. to form together an antenna structure.

The present invention thereby can allow the insulation sleeve members, namely the outer insulation sleeve 10 and the inner connecting rod 20, to be directly engaged with each other without other processing procedures to not only form a firmer connecting structure but also increase the torsional strength of the antenna in positioning in the peripheral direction. Therefore, the direct insertion-connecting antenna can have largely raised structural strength.

The above stated preferred embodiment is only for illustrating the present invention. It will be apparent to those skilled in this art that various modifications or changes can be made to the present invention. And all such modifications and changes also fall within the scope of the appended claims and are intended to form part of this invention.

What is claimed is:

1. A positioning structure of an inner and an outer insulation sleeve member for an antenna, said sleeve members are an outer insulation sleeve and an inner insulation connecting rod insertion connecting with each other to form the main housing of said antenna, wherein:

said outer sleeve has a top sealed end, a bottom opening, and an inner bore provided with an upper inner annular recess and a lower inner annular recess on the longitudinal wall thereof, and is provided near the inner top surface thereof with at least a pending tong;

the main shank of said inner connecting rod is in a corresponding shape to that of said inner bore of said outer sleeve, an upper and a lower annular protruding rib are provided on said inner connecting rod in corresponding in position to and for connecting with said upper and lower inner annular recesses respectively of said outer sleeve;

said inner connecting rod is provided thereon with notches corresponding in position to said pending tongs of said outer insulation sleeve;

when said outer sleeve and said inner connecting rod are insertion connected with each other, said pending tongs on said outer sleeve are synchronically connected with said notches provided on said inner connecting rod to make positioning in the peripheral direction.

2. A positioning structure of an inner and an outer insulation sleeve member for an antenna as claimed in claim 1, wherein, said pending tongs each is narrower at the lower end and wider at the upper end thereof, and said notches also each is narrower at the lower end and wider at the upper end thereof in coincidence in shape with a corresponding one of said pending tongs.

3. A positioning structure of an inner and an outer insulation sleeve member for an antenna as claimed in claim 1, wherein, said lower inner annular recess and said lower annular protruding rib of said outer sleeve and said inner connecting rod respectively are in truncated conical shapes flared downwardly to form on said inner connecting rod an abutting shoulder.

* * * * *